US009605438B1

(12) United States Patent
Bramble et al.

(10) Patent No.: US 9,605,438 B1
(45) Date of Patent: Mar. 28, 2017

(54) EXTERNALLY PROTRUDING LIGHT-CAPTURE WINDOW WELL

(71) Applicant: Dry Basement, Inc., Kansas City, MO (US)

(72) Inventors: Curtis Bramble, Kansas City, MO (US); Otto W. Fleck, Kansas City, MO (US); Lowell Hickman, Riverside, MO (US)

(73) Assignee: Dry Basement, Inc., Kansas City, MO (US)

( * ) Notice: Subject to any disclaimer, the term of this patent is extended or adjusted under 35 U.S.C. 154(b) by 0 days.

(21) Appl. No.: 14/859,553

(22) Filed: Sep. 21, 2015

(51) Int. Cl.

| | |
|---|---|
| ***F21S 11/00*** | (2006.01) |
| ***E04F 17/06*** | (2006.01) |
| ***E06B 7/28*** | (2006.01) |
| *E06B 9/24* | (2006.01) |

(52) U.S. Cl.
CPC ..... *E04F 17/06* (2013.01); *E06B 7/28* (2013.01); *F21S 11/007* (2013.01); *E06B 2009/2417* (2013.01)

(58) Field of Classification Search
None
See application file for complete search history.

(56) References Cited

U.S. PATENT DOCUMENTS 595,264 A * 12/1897 Ewen ..... F21V 5/02 359/594
1,669,663 A * 5/1928 Hobbie ..... F21S 11/00 359/592
2,237,564 A * 4/1941 Keyes ..... E04F 17/06 49/50
2,381,542 A * 8/1945 Hyatt ..... A47H 23/10 160/DIG. 7
2,844,998 A * 7/1958 Vincent ..... E04C 1/42 359/593

(Continued)

FOREIGN PATENT DOCUMENTS

CA 2303691 A1 * 10/2001 ..... E04F 17/06
CH EP 2662621 A2 * 11/2013 ..... F21V 33/006

(Continued)

OTHER PUBLICATIONS

Machine translation of DE 3831318 A1, date pulled Jan. 10, 2016, p. 1-5.*

(Continued)

*Primary Examiner* — Elizabeth A Quast
(74) *Attorney, Agent, or Firm* — Erise IP, P.A.

(57) ABSTRACT

A window well assembly for providing natural light to an interior of a dwelling comprising a light-refracting block, a flange, an outer gasket, an internal gasket, a reinforcing band, and a fastener. The window well assembly is installed into a wall in the dwelling where the light-refracting block externally protrudes from the wall for natural light refraction into the interior of the dwelling. The light-refracting block comprises a block body that presents an external receiving side, an external transmitting side, an upper wall-interfacing side, a lower wall-interfacing side, and an internal emergent side. Natural light enters the external receiving side or external transmitting side and refracts through the block body until emitted through the internal emergent side.

11 Claims, 7 Drawing Sheets

(56) References Cited

U.S. PATENT DOCUMENTS 3,214,879 A * 11/1965 Ellingson, Jr. ..... E06B 3/28 49/490.1
3,255,665 A * 6/1966 Weiher ..... F21S 11/00 359/595
3,393,034 A * 7/1968 Imai ..... F21S 11/00 359/514
3,438,699 A * 4/1969 Seeger ..... E06B 9/28 359/593
3,904,866 A * 9/1975 Hayes ..... B44F 1/06 359/592
4,562,675 A * 1/1986 Baigas, Jr. ..... E06B 3/285 160/354
4,569,872 A * 2/1986 Miller ..... B32B 27/08 428/178
5,027,566 A * 7/1991 Gilowski ..... E06B 1/363 52/18
5,408,795 A * 4/1995 Eljadi ..... E04D 13/03 126/698
D364,469 S * 11/1995 Eijadi ..... D25/48.7
5,467,564 A * 11/1995 DeKeyser ..... E04D 13/03 126/698
5,703,720 A * 12/1997 Fulco ..... E04F 17/06 359/591
5,828,494 A * 10/1998 Stremple ..... G02B 5/045 359/591
5,918,430 A * 7/1999 Rowland ..... E06B 3/28 244/129.3
6,176,289 B1 * 1/2001 McReynolds ..... E06B 9/26 160/168.1 R
6,311,437 B1 * 11/2001 Lorenz ..... E06B 9/24 359/592
7,850,320 B2 * 12/2010 Nagy ..... G02B 5/04 359/615
2011/0265398 A1 * 11/2011 Rosales Pino ..... F21S 11/00 52/173.1
2013/0279009 A1 * 10/2013 Hsu ..... G02B 19/0042 359/597

FOREIGN PATENT DOCUMENTS

DE 3103715 A1 * 9/1982 ..... E04F 17/06
DE 3831318 A1 * 3/1990 ..... E04F 17/04
DE 4423831 A1 * 5/1995 ..... E04F 17/06
DE 102007044791 A1 * 5/2009 ..... E04F 17/06
DE 202015102325 U1 * 5/2015 ..... E04F 17/06
JP 11111026 A * 4/1999

OTHER PUBLICATIONS

Machine translation of DE 202015102325 U1, date pulled Jan. 10, 2016, p. 1-6.*

* cited by examiner

EXTERNALLY PROTRUDING LIGHT-CAPTURE WINDOW WELL

BACKGROUND

1. Field

Embodiments of the invention provide an improved window well assembly for attachment to a dwelling and for allowing natural light to illuminate part of the dwelling. More particularly, embodiments of the invention provide a window well assembly that protrudes externally from a wall of the dwelling to maximize natural light refraction into the interior of the dwelling.

2. Related Art

Window well assemblies are commonly used to provide natural light to the interior of a dwelling. Window well assemblies are traditionally installed against an exterior of a basement wall in the dwelling at or below ground level. These window well assemblies require an open space to be excavated in front of a basement window so as to present a well or hole approximately greater in width and height than the window. The well or hole is often lined with a window well structure to prevent dirt accumulation on the exterior of the basement window.

Prior art window well assemblies, such as those separately attached to an exterior of the dwelling without a top or cover, are prone to allow water damage in the interior of the dwelling. This is because the open excavated space in front of the window presents a cavity that allows water to collect and pool. Further, hydrostatic pressure from the displacement of dirt continuously pushes against a flange of the window well structure, often causing the flange to deflect and an associated gasket seal to break. Water may then collect in the open well space and seep into the interior of the dwelling.

Accordingly, there is a need for a completely sealed, light-capturing window well assembly that does not require the large excavated space in front of the window that causes structural integrity and water infiltration issues.

SUMMARY

Embodiments of the invention solve the above-mentioned problems by providing an externally protruding window well assembly that is a completely sealed, non-ventilating unit for providing natural light into the interior of a dwelling. The externally protruding window well assembly does not require the large, open excavated space in front of a window that conventional window wells require. This is because the externally protruding window well assembly comprises a light-refracting block positioned where a normal window would be. The light-refracting block protrudes externally from a wall of the dwelling at a much smaller horizontal distance than previous window wells. The light-refracting block is also a sealed monolithic unit and therefore, does not comprise a cavity where water could collect and seep into the interior of the dwelling. Further, because the light-refracting block protrudes externally from the dwelling, dirt may extend vertically along a portion of the light-refracting block while still maintaining adequate natural light delivery to the interior of the dwelling. Additionally, the externally protruding window well assembly does not have the structural integrity issues of prior art window wells due to the window well of embodiments of the invention being a monolithic unit.

A first embodiment of the invention is directed to an externally protruding window well assembly for providing natural lighting to an interior of the dwelling. The externally protruding window well assembly comprises a light-refracting block, a flange, an outer gasket, a reinforcing band, and a fastener. The light-refracting block protrudes externally from the dwelling to capture natural light for illumination of the dwelling. The flange is used to couple the light-refracting block to an exterior wall of the dwelling. The outer gasket seals the light-refracting block to the exterior wall of the dwelling. The reinforcing band is positioned adjacent to the outer gasket to prevent the outer gasket from wavering. The fastener is used for fastening the externally protruding window well assembly to the exterior wall of the dwelling.

A second embodiment is directed to a light-refracting block configured to externally protrude from the dwelling to allow natural light refraction into the interior of the dwelling. The light-refracting block comprises a block body. The block body is a monolithic unit presenting an external receiving side, an external transmitting side, an upper wall-interfacing side, a lower wall-interfacing side, and an internal emergent side. The internal emergent side of the block body is parallel with the exterior wall of the dwelling. The external receiving side is disposed adjacent to the upper wall-interfacing side and adjacent to the external transmitting side for the capture of natural light from the exterior of the dwelling.

A third embodiment is directed to a method of installing the externally protruding window well assembly to a wall of the dwelling. The method comprises the following steps. The externally protruding window well assembly is coupled to the wall of the dwelling using a plurality of fasteners driven through a flange along the perimeter of a light-refracting block. The light-refracting block is secured to an exterior wall of the dwelling via an outer gasket. A reinforcing band is fastened on top of the outer gasket along a perimeter of the externally protruding window well assembly to prevent wavering or movement of the gasket.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
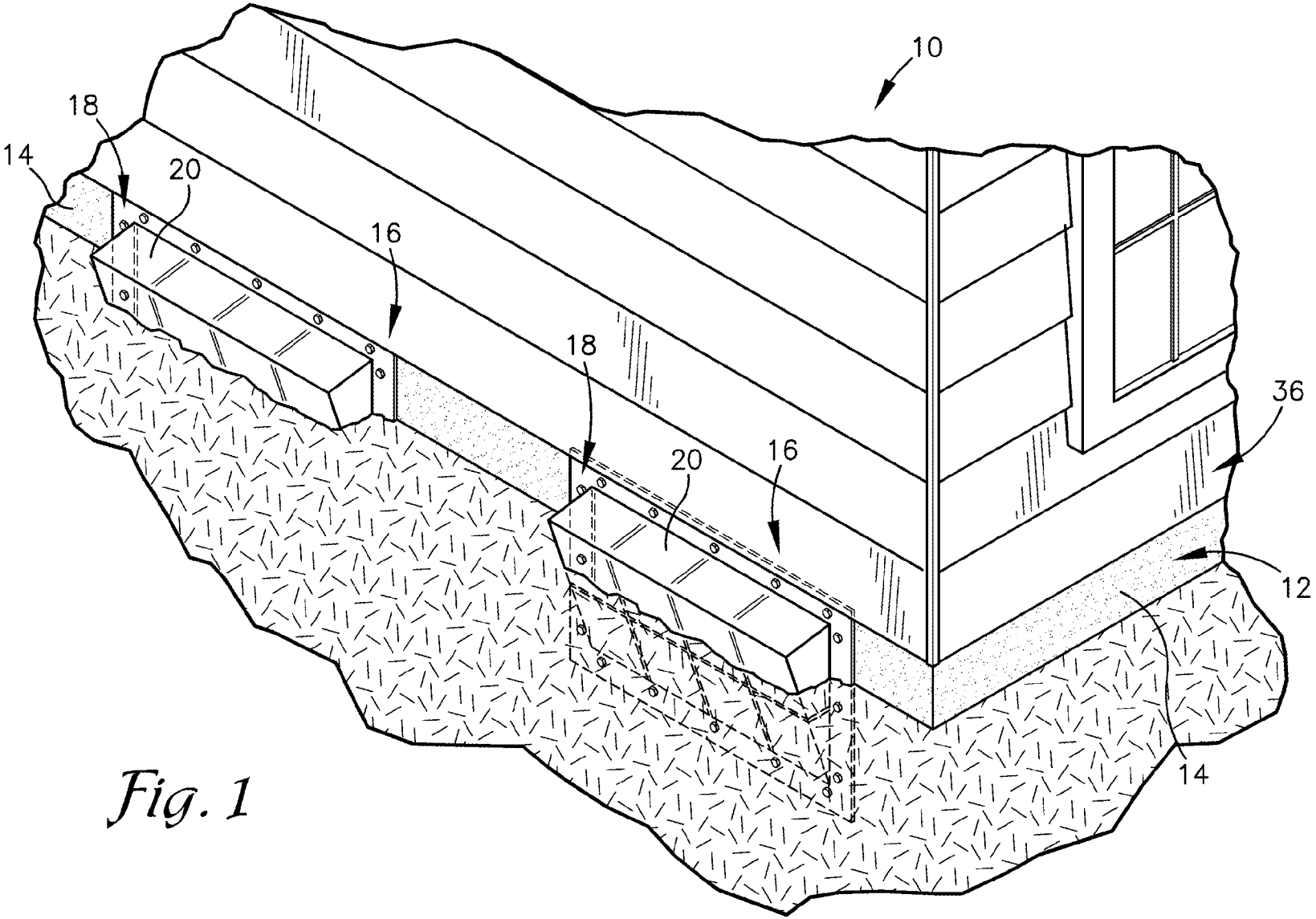
FIG. 1 is a perspective view of an externally protruding window well assembly of embodiments of the invention installed in a basement.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 3:
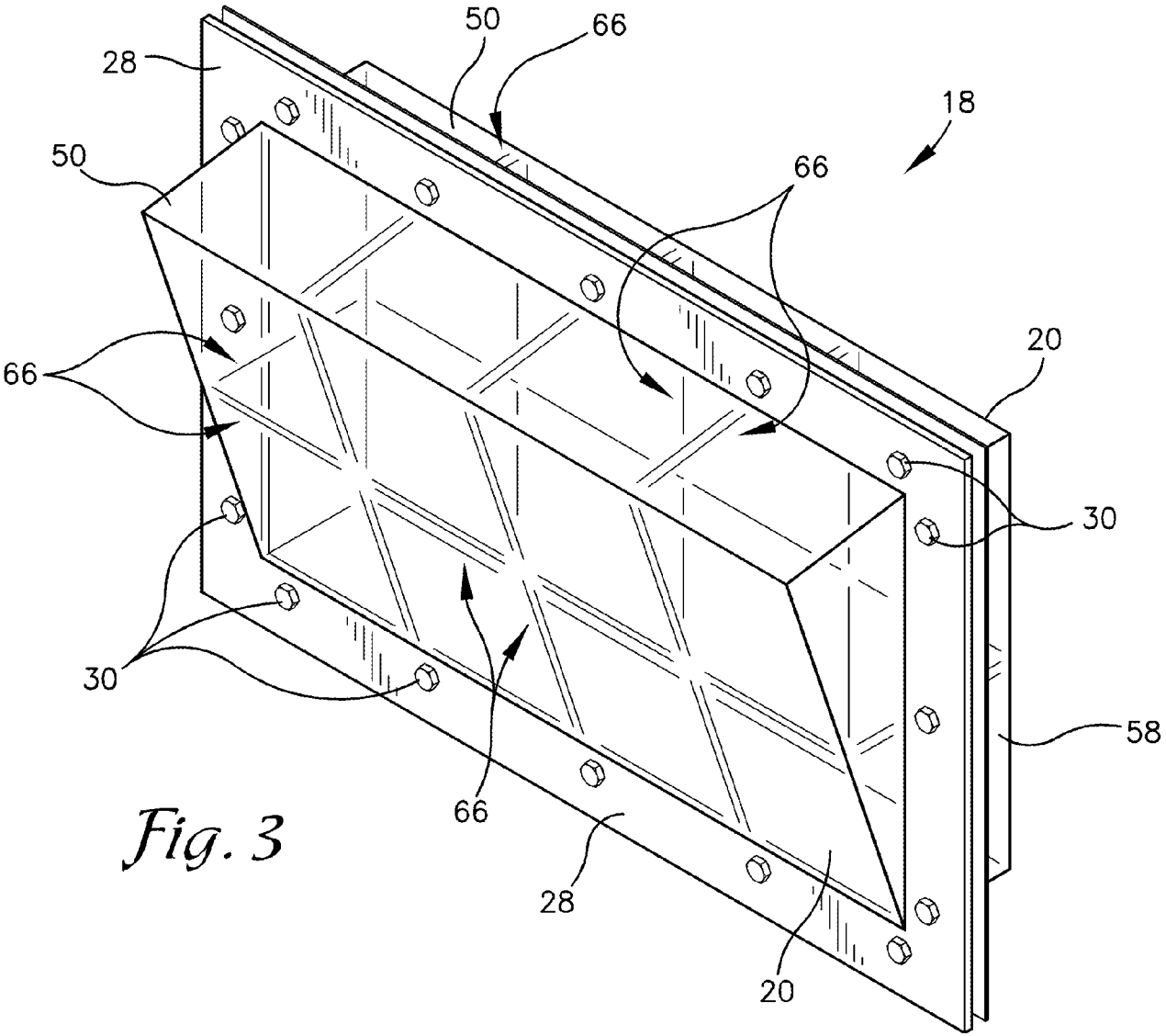
FIG. 3 is a perspective view of the externally protruding window well assembly of FIG. 1.
Figure 4:
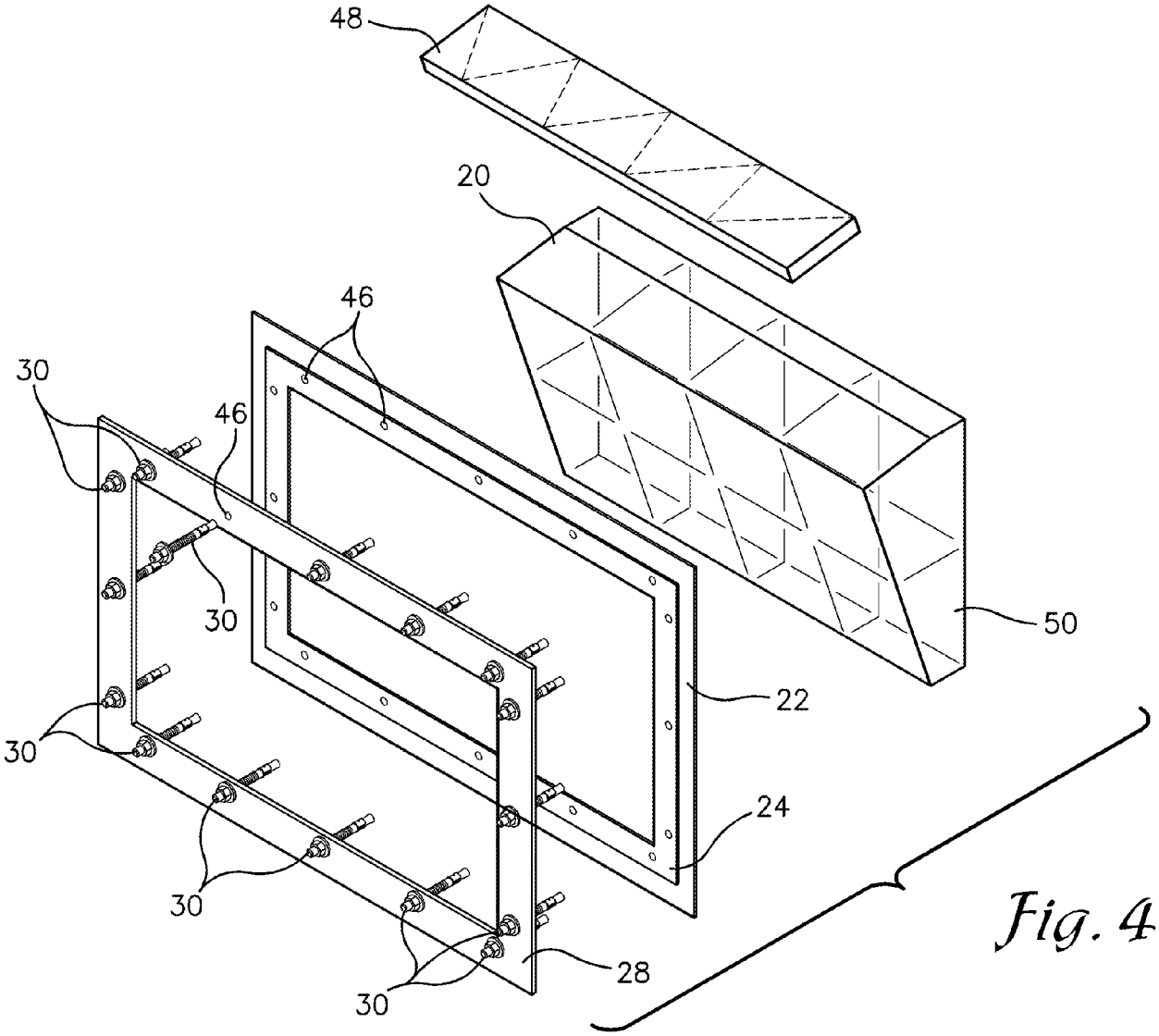
FIG. 4 is an exploded view of the externally protruding window well assembly of FIG. 3 to illustrate the components of the window well assembly.

Referring now to FIG. 1, in a first embodiment of the invention, the dwelling 10 with a basement 12 is shown, along with a basement wall 14 having an opening 16 formed in the basement wall 14. An externally protruding window well assembly 18 may be installed into the opening 16 for refraction of natural light into the interior of the dwelling. Referring to FIGS. 3 and 4, the externally protruding window well assembly 18 broadly comprises a light-refracting block 20 inserted into the wall opening 16, a flange 22 for coupling the light-refracting block 20 to the basement wall 14, an outer gasket 24 for securing the light-refracting block 20 vertically in line with an exterior of the basement wall 14, an internal gasket 26 for sealing the light-refracting block 20 together (illustrated in FIG. 7), a reinforcing band 28 mounted on top of the outer gasket 24 and along a perimeter of the externally protruding window well assembly 18 to prevent wavering or movement of the gasket, and a fastener 30 to fasten the externally protruding window well assembly 18 to the basement wall 14.

Figure 2:
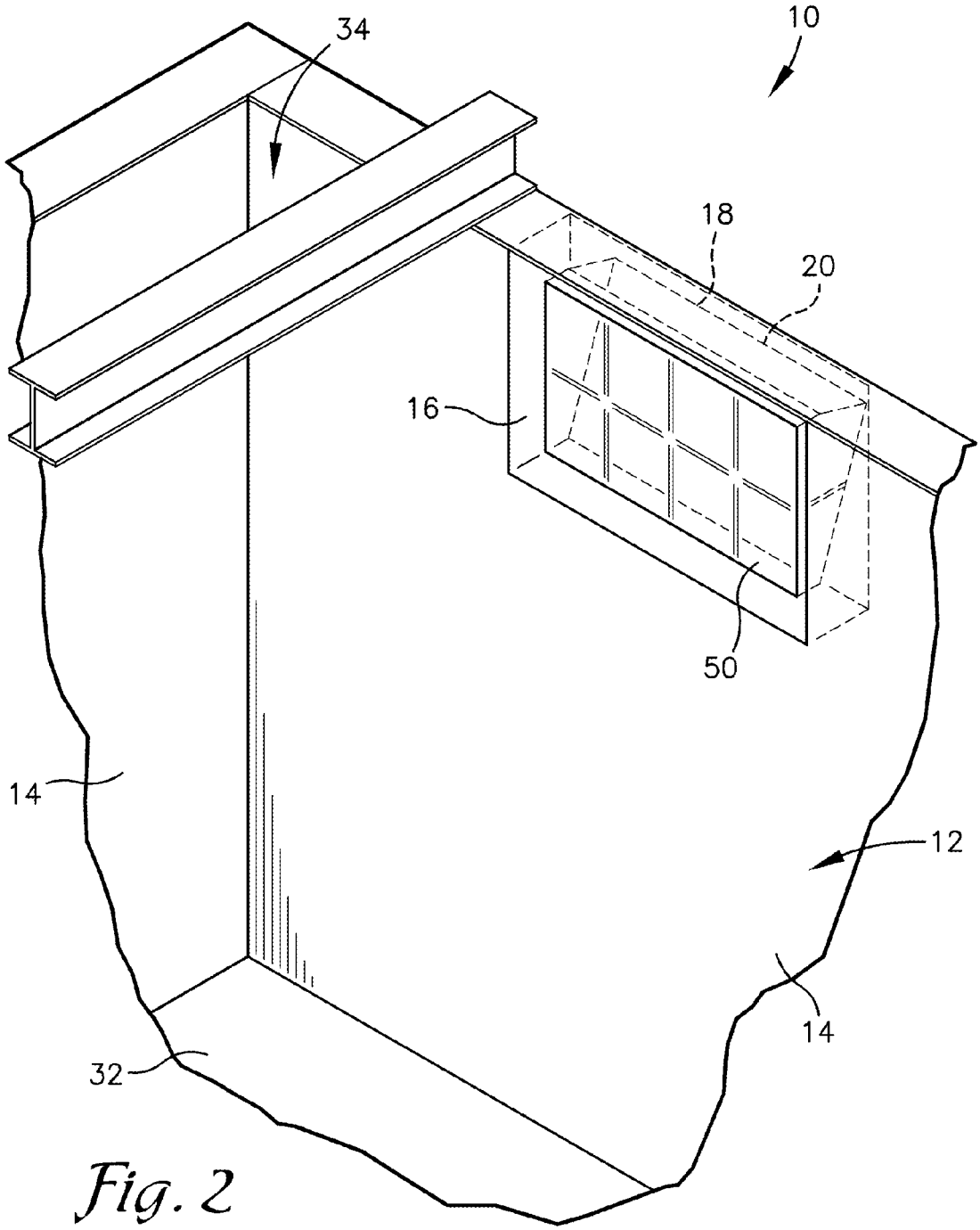
FIG. 2 is a perspective view of an interior of the dwelling illustrating the interior view of the window well assembly.

Referring to FIG. 2, the opening 16 is depicted near a top portion of the basement wall 14 of the dwelling 10. The basement 12 broadly comprises a floor 32, a ceiling 34, and a plurality of side walls (such as a left-side wall, a right-side wall, a front wall, and a rear wall). The dwelling 10 also comprises at least one level, but may comprise two or more levels with one level being the basement 12. The basement 12 may be primarily below ground or even with the exterior ground elevation. The externally protruding window well assembly 18 may be attached to the front wall, the rear wall, the left-side wall, or the right-side wall to allow light to enter the interior of the dwelling.

It should be appreciated that the majority of this description is directed to the dwelling 10 being a residential housing structure. In other embodiments, the dwelling 10 is an industrial structure, a commercial structure, or any other structure that could allow natural light refraction into its interior. In embodiments of the invention, the externally protruding window well assembly 18 is attached to an industrial structure, such as a factory, for light refraction into the interior of the structure. In further embodiments of the invention, the externally protruding window well assembly 18 is attached to a commercial structure, such as a store, for light refraction into the interior of the structure.

Referring to FIG. 2, the basement walls 14 are generally rectangular in shape when viewed by an observer from the interior or exterior of the dwelling. The opening 16 formed at the top of the front wall, the rear wall, the left-side wall, or the right-side wall of the dwelling 10 may come from manually cutting out a portion of the wall to allow the installation of the externally protruding window well assembly 18. The opening 16 may also come from the removal of a pre-existing basement window. The opening 16 is generally rectangular in shape, allowing the four corners of a rectangular portion of the externally protruding window well assembly 18 to insert into the open space. However, in other embodiments of the invention, the opening 16 may be other shapes, and the window well assembly 18 of embodiments may have a similar shape to the opening 16 in the building.

Although the dimensions of the opening 16 may vary widely, an exemplary opening 16 for the externally protruding window well assembly 18 has a height of approximately 10-30 inches, approximately 12-25 inches, or approximately 18 inches. An exemplary opening 16 for the externally protruding window well assembly 18 has a width of approximately 20-40 inches, approximately 25-35 inches, or approximately 33 inches. An exemplary opening 16 for the externally protruding window well assembly 18 has a depth of approximately 2-10 inches, approximately 4-8 inches, or approximately 6 inches. In embodiments of the invention, the opening 16 formed in a wall of the dwelling may be circular in shape for insertion of a circular window well assembly. In embodiments of the invention, varying dimensions may be used for the opening 16 in a wall of the dwelling with differing dwelling 10 shapes and sizes.

Referring to FIG. 3, the externally protruding window well assembly 18 for insertion into an opening 16 in a basement wall 14 broadly comprises a light-refracting block 20 inserted into the opening 16, a flange 22 used to couple the light-refracting block 20 to an exterior wall of the basement, an outer gasket 24 (not visible in FIG. 3, see FIG. 4) for securing the light-refracting block 20 vertically in line with an exterior wall of the basement, the reinforcing band 28 adjacent to the outer gasket 24 and along a perimeter of the externally protruding window well assembly 18 to prevent the outer gasket 24 from wavering or moving (i.e. failing such that water may pass through the outer gasket), and the fastener 30 to couple the externally protruding window well assembly 18 to the basement wall 14.

Typically, the externally protruding window well assembly 18 is of a size and shape that is the same as or slightly smaller than the opening 16. Although the dimensions of the externally protruding window well assembly 18 may vary widely, an exemplary externally protruding window well assembly 18 has a height of approximately 10-30 inches, approximately 12-25 inches, or approximately 18 inches. An exemplary externally protruding window well assembly 18 has a width of approximately 20-40 inches, approximately 25-35 inches, or approximately 33 inches. An exemplary externally protruding window well assembly 18 has a varying depth when viewed along a vertical axis of approximately 2-10 inches, approximately 4-8 inches, or approximately 6 inches. In embodiments of the invention, varying dimensions of the externally protruding window well assembly 18 may be used with differing basement wall 14 shapes, lengths, heights, widths, and depths.

In other embodiments of the invention, the externally protruding window well assembly 18 is inserted into an opening 16 disposed in a middle portion of the basement wall 14 to portray the normal appearance of a window when viewed by an observer from the interior of the dwelling. In alternative embodiments of the invention, the externally protruding window well assembly 18 is inserted into an opening 16 in a bottom portion of a basement wall 14 in the dwelling 10 for natural light refraction into the interior of the dwelling. In other embodiments of the invention, multiple window well assemblies 18 are installed into the basement 12 of the dwelling 10; one or more on each wall for maximizing the time natural light may enter the interior of the dwelling.

As illustrated in FIGS. 1 and 2, in embodiments of the invention the externally protruding window well assembly 18 is non-ventilating to prevent moisture from seeping into the dwelling 10. The externally protruding window well assembly 18 is completely sealed from the exterior of the dwelling to the interior of the dwelling. In other embodiments, not illustrated and discussed below, the externally protruding window well assembly 18 is selectively ventable so as to allow air flow into the dwelling 10. In still other embodiments, the externally protruding window well assembly 18 is egressible so as to allow a person to exit the dwelling therethrough. This may be advantageous in an emergency situation and to allow the basement 12 to be a conforming bedroom.

Further, in embodiments of the invention, the light-refracting block 20 is monolithic and therefore seamless to prevent moisture from seeping in, as discussed below. The flange 22 couples the light-refracting block 20 to the basement wall 14. The outer gasket 24 seals the light-refracting block 20 to the opening 16 in the basement wall 14, further preventing moisture from entering the dwelling 10 behind the flange 22 and reducing the need for a drain (which are common in window well assemblies of the prior art). The generally rectangular reinforcing band 28 prevents wavering of the outer gasket 24 and thus prevents moisture from entering the dwelling 10.

In embodiments of the invention, best illustrated in FIG. 4, the flange 22 is positioned around the perimeter of the light-refracting block 20 to allow for coupling of the light-refracting block 20 to the basement wall 14. The flange 22 is parallel to a siding 36 of the dwelling 10 and coupled via a plurality of fasteners 30 evenly spaced around the flange's 22 perimeter. As illustrated the flange 22 is secured to the outer gasket 24. This prevents the passing of moisture between the externally protruding window well assembly 18 and the dwelling 10. In other embodiments, the flange 22 and the outer gasket 24 are separate and distinct components.

The outer gasket 24 secures and seals the externally protruding window well assembly 18 to the basement wall 14 to prevent moisture from seeping into the dwelling 10. In embodiments of the invention, the outer gasket 24 is positioned around the perimeter of the light-refracting block 20 and vertically in line with the siding 36 of the dwelling 10. The outer gasket 24 extends along the perimeter of the light-refracting block 20 even with the vertical siding 36 of the dwelling 10. The outer gasket 24 continues to extend to a point at the bottom of the light-refracting block 20 even with the vertical siding 36 of the dwelling 10.

The outer gasket 24 secures the externally protruding window well assembly 18 to the basement wall 14 to prevent moisture from seeping into the dwelling 10. In addition, as discussed below, the light-refracting block 20 is canted such that water cannot accumulate thereon and the externally protruding window well assembly 18 is non-ventilating.

Figure 7:
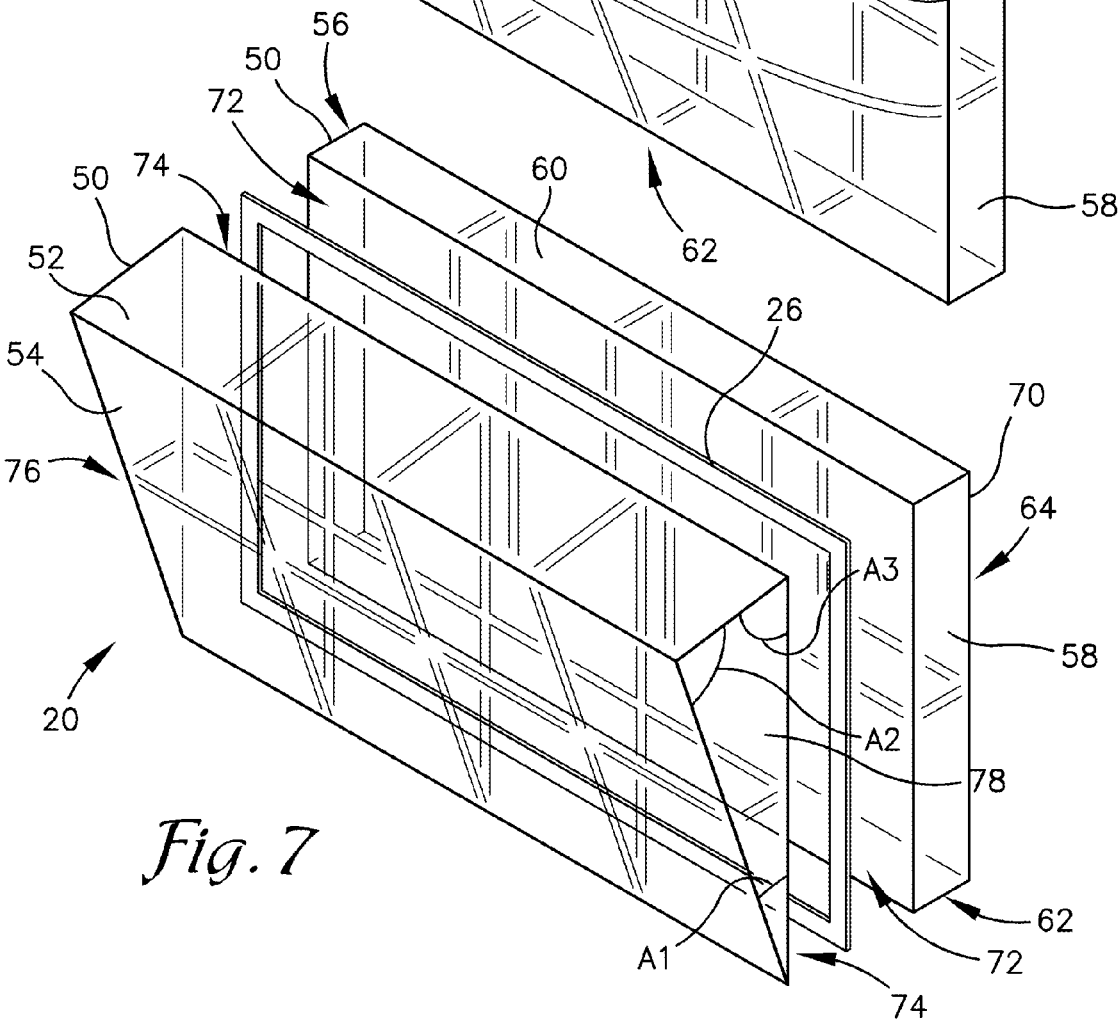
FIG. 7 is a perspective view of an embodiment of the block body that is polylithic, specifically illustrating an internal gasket.

As illustrated in FIG. 7, embodiments of the light-refracting block 20 include the internal gasket 26 that is positioned therein to prevent water or other liquids from damaging the light-refracting block 20 from within. The internal gasket 26 further seals the externally protruding window well assembly 18 by preventing moisture from entering the externally protruding window well assembly 18. This prevents moisture from inside the dwelling 10 from entering and corroding the externally protruding window well assembly 18. This also prevents moisture that has managed to seep into the externally protruding window well assembly 18 from entering the interior of the dwelling 10. Moisture, therefore, cannot form in the inside of the dwelling 10 or on the inside of the light-refracting block 20 at the point where the outer gasket 24 is in line with the siding 36 of the dwelling 10.

Typically, the flange 22, the outer gasket 24, and the internal gasket 26 are formed of a polymeric material. The flange 22, the outer gasket 24, and the internal gasket 26 all conform to some degree to the location in which they are installed. The non-rigid, pliable nature of these components allows for them to fill gaps and prevent the passing of moisture. Polymers are also resistant to damage and corrosion. It should also be appreciated that additional sealing materials can be used to prevent moisture passage in addition or in the alternative. For example, a caulk or another sealant may be applied to the intersection between the externally protruding window well assembly 18 and the opening 16. In some examples, the externally protruding window well assembly 18 comprises the light-refracting block 20 and a caulk applied thereto. Further, the internal gasket 26 in embodiments of the invention is formed of a transparent or a translucent material, so as to minimize the disturbance of light traveling through the light-refracting block 20.

The generally rectangular reinforcing band 28 is fastened on top of the outer gasket 24 via a plurality of fasteners 30 such as screws, bolts, wedge anchors, or other fastening devices. The generally rectangular reinforcement band 28 prevents wavering of the outer gasket 24 that may result from continuous exposure to hydrostatic pressure. In embodiments of the invention, the reinforcing band 28 may be formed of various materials, shapes, and sizes depending on the structure of the externally protruding window well assembly 18 and shape of the basement wall 14. In embodiments of the invention, the reinforcing band 28 is composed of aluminum. In other embodiments of the invention, the reinforcing band 28 is composed of stainless steel, or other non-corroding and non-rusting metals. In other embodiments of the invention, the reinforcing band 28 is composed of or covered with a material to match or simulate the siding 36 on the dwelling 10. For example, the reinforcing band 28 may include vinyl siding, polymeric siding, brick, wood, rock, stucco, shingles, or the like. The reinforcing band 28 may additionally, or in the alternative, present a color to match a color presented by the siding 36.

Figure 8:
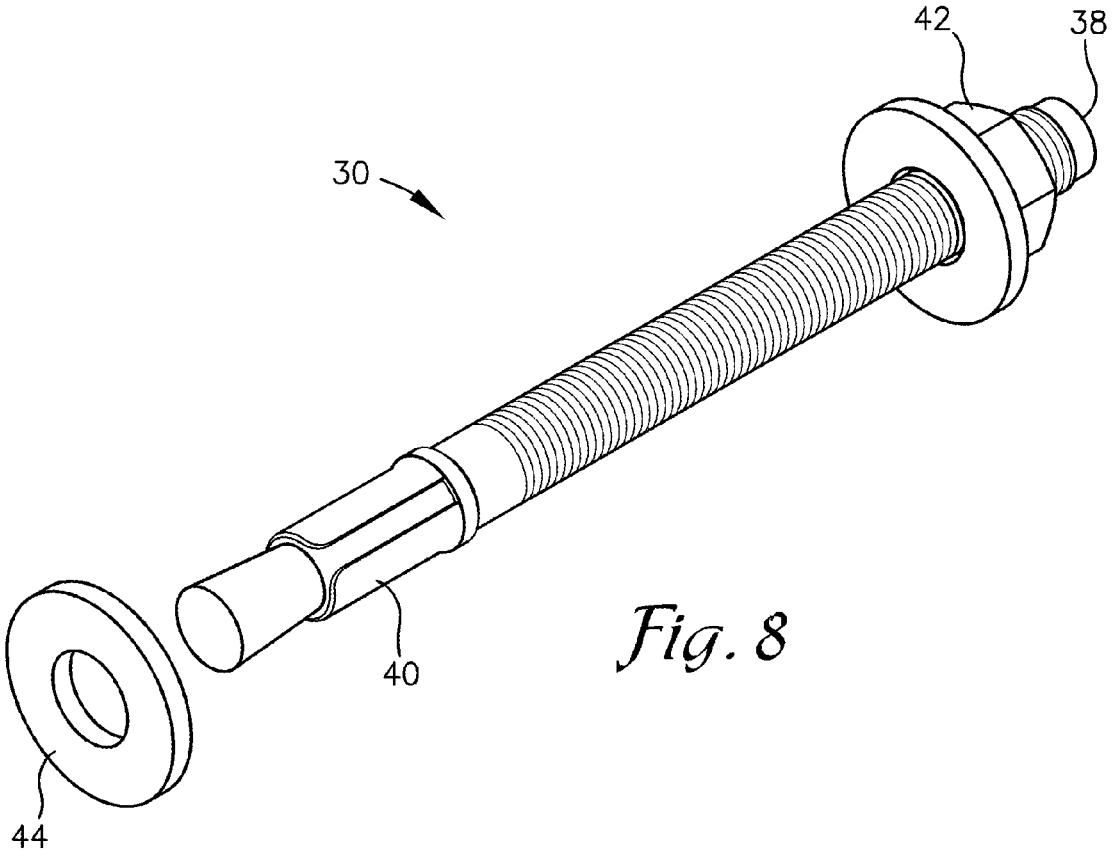
FIG. 8 is a perspective view of a fastener used to secure the externally protruding window well assembly to the dwelling.

The fastener 30 is configured to fasten the externally protruding window well assembly 18 to the basement wall 14 of the dwelling 10. A plurality of fasteners 30 is positioned around the perimeter of the externally protruding window well assembly 18 for attachment to the basement wall 14. An exemplary fastener 30 is illustrated in FIG. 8. The fastener 30 comprises an anchor body 38, an expansion clip 40, a nut 42, and a washer 44 (a fastener of this type is commonly known as a "wedge anchor"). The anchor body 38 is to be inserted into a fastener receptor 46 made in the basement wall 14 substantially equal to or slightly larger than the diameter of the fastener 30. The expansion clip 40 is to be driven through a flange 22 positioned around the perimeter of the light-refracting block 20. The nut 42 is threaded onto the threaded end of the fastener 30 to protect the threads during installation. The washer 44 is to be tightened on the exterior of the basement wall 14.

In an alternative embodiment of the invention, the window-well assembly 18 is a ventilating unit comprising a light-refracting block 20 that is inserted into an opening 16 in a wall of the dwelling 10, a flange 22 around the perimeter of the light-refracting block 20, an outer gasket 24 for securing the light-refracting block 20 vertically in line with an exterior wall of the basement, an internal gasket 26 for sealing the light-refracting block 20, a reinforcing band 28 on top of the outer gasket 24 along the perimeter of the externally protruding window well assembly 18 to prevent the outer gasket 24 from wavering, and an egress hinge (not illustrated) at the bottom and top of the externally protruding window well assembly 18 to attach the externally protruding window well assembly 18 to the basement wall 14 and allow for ventilation by an in-swinging or out-swinging motion.

The egress hinge comprises a plurality of arms, a plurality of screws, a sliding brass shoe, a lever system, and a hinge track. An egress hinge attaches to the bottom and top of the light-refracting block 20 to allow for 90-degree in-swinging movement when the lever is rotated. Rotating the lever counterclockwise slides an arm along the hinge track and opens the externally protruding window well assembly 18 inwards until the 90-degree point is reached. Rotating the lever clockwise will reposition the externally protruding window well assembly 18 in line with the siding 36 of the dwelling 10. In one example, the egress hinge comprises four arms, six screws, a sliding brass shoe, a lever system and a hinge track.

Figure 5:
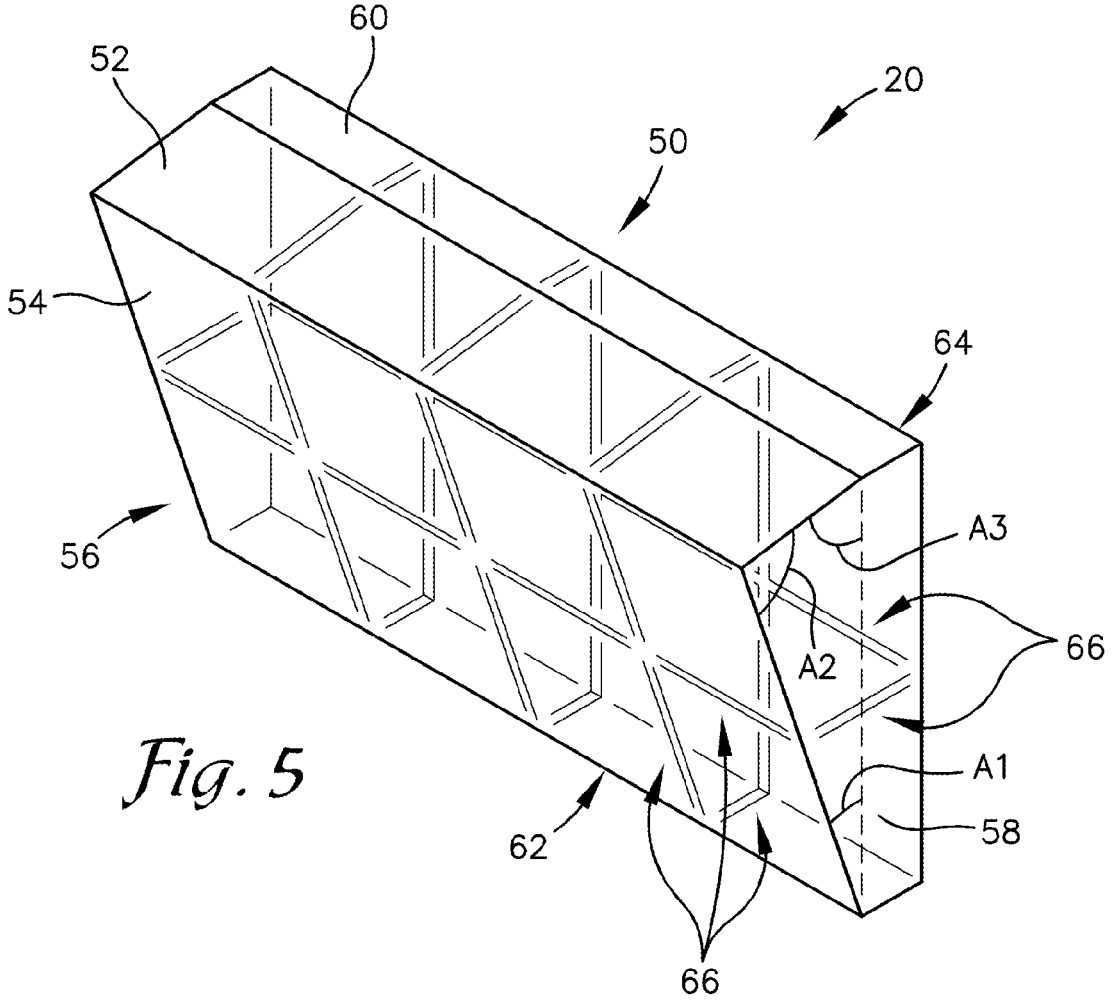
FIG. 5 is a perspective view of an embodiment of a block body of the externally protruding window well assembly having a canted and straight external receiving side.

Referring to FIG. 5, a light-refracting block 20 comprising a block body 50 as a monolithic unit is shown. The block body 50 presents an external receiving side 52, an external transmitting side 54, a left wall-interfacing side 56, a right wall-interfacing side 58, an upper wall-interfacing side 60, a lower wall-interfacing side 62, and an internal emergent side 64. The external receiving side 52 is adjacent to the upper wall-interfacing side 60 and the external transmitting side 54. The external receiving side 52 protrudes outwards at least 4 inches to the exterior of the dwelling 10, horizontally from the upper wall-interfacing side 60 to allow natural light refraction into the dwelling 10. The external transmitting side 54 is adjacent to the lower wall-interfacing side 62 and the external receiving side 52. The left wall-interfacing side 56 is adjacent to the external transmitting side 54 and the internal emergent side 64 on the left of the light-refracting block 20. The right wall-interfacing side 58 is adjacent to the external transmitting side 54 and the internal emergent side 64 on the right of the light-refracting block 20.

In some embodiments of the invention, the upper wall-interfacing side 60 of the block body 50 is parallel to a horizontal sill plate (not illustrated) in the basement wall 14, configured for attachment to the sill plate or the basement wall 14 by fasteners. The lower wall-interfacing side 62 is parallel to a horizontal section of the opening 16 configured to receive the externally protruding window well assembly 18. The internal emergent side 64 is perpendicular to the upper wall-interfacing side 60 and lower wall-interfacing side 62 and parallel with the exterior wall of the dwelling. It should be noted that a series of broken lines 66 are illustrated in the block body 50. These broken lines 66 are used to portray block body's 50 three-dimensional shape.

Natural light in the form of an incident ray enters the external receiving side 52 and is absorbed at a point of contact. The incident ray then refracts inside the block body 50, resulting in a refracted ray. The refracted ray is then transmitted at its angle of refraction through the internal emergent side 64 into the interior of the dwelling in the form of an emergent ray. Natural light may also enter the external transmitting side 54 in the same manner to allow natural light refraction into the interior of the dwelling.

In an embodiment of the invention as seen in FIGS. 4-5, the external receiving side 52 is canted. The light-refracting block 20 with the external receiving side 52 presents a pentagonal prism. The external receiving side 52 is used to prevent water accumulation on an outer surface of the light-refracting block 20 that could inhibit light refraction into the dwelling 10. The external receiving side 52 extends at a length relative to the height of the internal emergent side 64, such as at least one eighth, at least one quarter, or at least one third the height of the internal emergent side 64. The external receiving side 52 is angled away from the upper wall-interfacing side 60 to allow natural light refraction into the dwelling 10. The external receiving side 52 also allows for dirt to accumulate along the vertical exterior of the external transmitting side 54, covering it completely until level with the external receiving side 52 while still maintaining light refraction into the dwelling 10.

As illustrated in FIGS. 5 and 7, three angles (labeled A1, A2, and A3) are presented by the window well assembly 20. A1 is the angle between the external transmitting side 54 and a hypothetical vertical line that is perpendicular to the lower wall-interfacing side 62. A2 is the angle between the external receiving side 52 and the external transmitting side 54. A3 is the angle between the external receiving side 52 and the above-mentioned hypothetical vertical line. In embodiments of the invention, A1 and A3 are each an acute angle. In embodiments of the invention, A2 is a right angle or substantially a right angle. In other embodiments, A2 is an obtuse angle.

The Law of Cosines can be used to determine the interior angles A1, A2, and A3. In one example, a length of 6 inches is used for the external receiving side 52, 16 inches for a straight-shaped external transmitting side 54, and 18 inches for the above-mentioned hypothetical vertical line. In this example, A1 is approximately 19 degrees, A2 is approximately 100 degrees, and A3 is approximately 61 degrees. In embodiments of the invention, A1 may be between 5 and 45 degrees, between 10 and 30 degrees, or between 15 and 20 degrees. In embodiments of the invention, A2 may be between 60 and 120 degrees, between 70 and 110 degrees, or between 80 and 100 degrees. In embodiments of the invention, A3 may be between 30 and 90 degrees, between 40 and 80 degrees, or between 50 and 70 degrees. It should be noted that the sum of A1, A2, and A3 must equal 180 degrees. Further, it should be noted that the opposite face of the light-refracting block 20 would present substantially the same angles.

In an alternative embodiment of the invention, not illustrated, the light-refracting block 20 comprises multiple canted external receiving sides in a step-wise fashion to optimize natural light refraction into the interior of the dwelling. An uppermost external receiving side 52 extends at the greatest length away from the upper wall-interfacing side 60. Subsequent canted external receiving sides are positioned below the uppermost external receiving side 52 along the external transmitting side 54 and decrease in length as they descend down the external transmitting side 54. The subsequent canted external receiving sides also increase their canted angle as they descend down the external transmitting side 54 to position a canted side in the direct rays of natural light as the sun revolves. In embodiments of the invention, the light-refracting block 20 presents a polylithic unit that includes the external receiving side 52 being canted downward as discussed above.

In an embodiment of the invention, the light-refracting block 20 of FIG. 5 comprises a block body 50 with an external transmitting side 54 having a substantially straight shape. When viewed from a center point inside the block body 50 where a vertical axis and a horizontal axis intersect at the center point, the block body 50 presents a slanted-front pentagonal prism.

Figure 6:
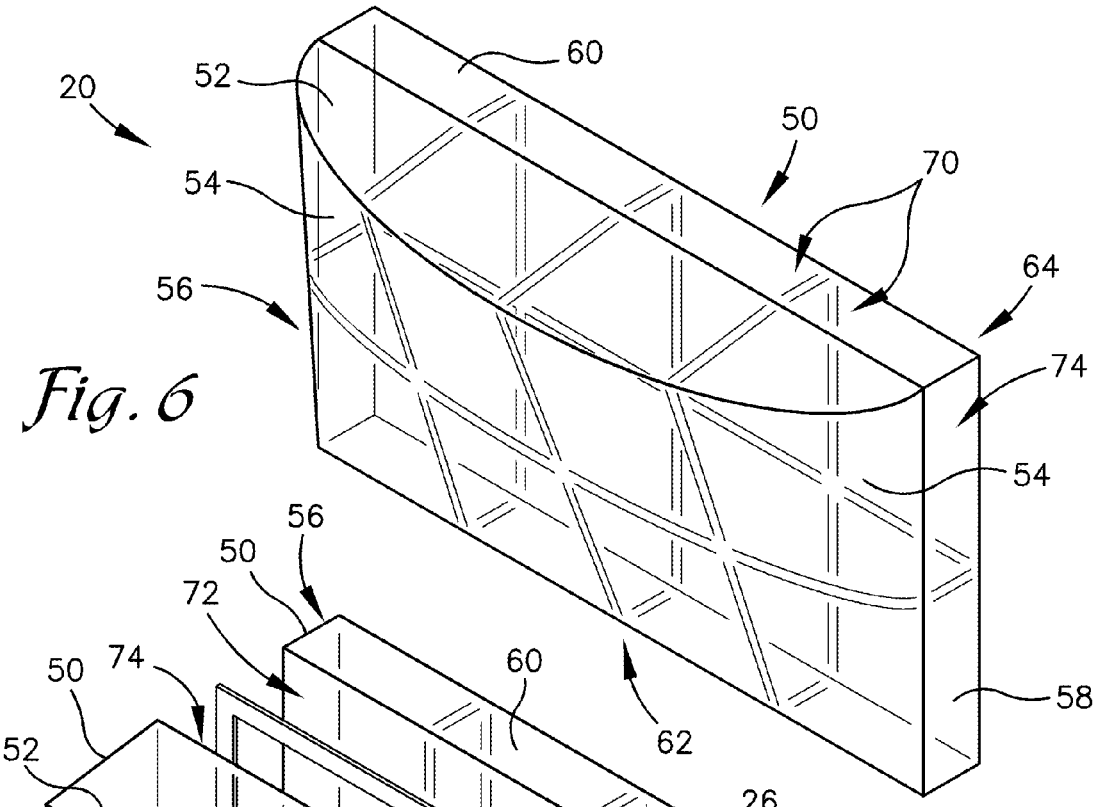
FIG. 6 is a perspective view of an embodiment of the block body of the externally protruding window well assembly having a canted and arcuate external receiving side.

In an embodiment of the invention, the light-refracting block 20 of FIG. 6 comprises a block body 50 with an external transmitting side 54 having an arcuate shape. When viewed from a center point inside the block body 50 where a vertical axis and a horizontal axis intersect at the center point, the block body 50 presents an arcuate prism in a proximal end and a rectangular base in a distal end.

In embodiments of the invention, as illustrated in FIGS. 5 and 6, the block body 50 is monolithic. The block body 50 is unitary, i.e. formed of a single, continuous material. This may be advantageous in that the reduces light scatter by having a single continuous material through which the light travels.

In other embodiments of the invention as seen in FIG. 7, the block body 50 is a polylithic unit comprised of a light-receiving segment 68, a light-emitting segment 70, and the internal gasket 26. The light-receiving segment 68 presents a first interior refraction side 72 that mates with a second interior refraction side 74 of the light-emitting segment 70. The light-receiving segment 68 presents the external receiving side 52, the external transmitting side 54, the first interior refraction side 72, a left external transmitting side 76, and a right external transmitting side 78. The external receiving side 52 is disposed opposite an angle the external transmitting side 54 and the light-emitting segment 70 meet and is not canted. The external transmitting side 54 is positioned adjacent to the external receiving side 52 and the first interior refraction side 72. The external transmitting side 54 is substantially straight shaped, presenting a triangular prism for the light-receiving segment 68. The first interior refraction side 72 is substantially vertically aligned with the basement wall 14 and shared with the light-emitting segment 70.

In one example, when taking a length of 6 inches for the external receiving side 52, 16 inches for the external transmitting side 54, and 17 inches for the first interior refraction side 72, the Pythagorean theorem can be used to determine the interior angles of one side of the triangular prism forming a right triangle on either the left wall-interfacing side 56 or the right wall-interfacing side 58. The angle between the interior refraction side and the external transmitting side 54 is approximately 21 degrees; the angle between the interior refraction side and the external receiving side 52 is approximately 90 degrees; and the angle between the external receiving side 52 and the external transmitting side 54 is approximately 69 degrees. The right triangle positioned on the opposite face of the light-receiving segment 68 would present the same angles and lengths. The light-receiving segment 68 is configured for attachment to the light-emitting segment 70 via fasteners or adhesives.

The light-emitting segment 70 of FIG. 7, in embodiments of the invention, presents a substantially rectangular prism shape. The light-emitting segment 70 comprises the upper wall-interfacing side 60, the lower wall-interfacing side 62, the left wall-interfacing side 56, the right wall-interfacing side 58, the internal emergent side 64, and the second interior refraction side 74. The second interior refraction side 74 is substantially vertically aligned with the basement wall 14 and adjacent to the light-receiving segment 68. The upper wall-interfacing side 60 is perpendicular to the second interior refraction side 74. The lower wall-interfacing side 62 is parallel with the upper-wall interfacing side 60. The internal emergent side 64 is parallel to the second interior refraction side 74 and adjacent to the upper wall-interfacing side 60 and the lower wall-interfacing side 62. The angles between the sides of the light-emitting segment 70 are therefore substantially 90 degrees in this embodiment of the invention.

In a further embodiment of the invention, the external transmitting side 54 of the light-receiving segment 68 is generally arcuate shaped, presenting an arcuate prism, similarly to FIG. 6. The light-receiving segment 68 is configured for attachment to the light-emitting segment 70 via fasteners or adhesives as in FIG. 7.

In embodiments of the invention, the light-refracting block 20 is formed entirely or in part of an acrylic polymer. In embodiments of the invention, the light-refracting block 20 is formed entirely or in part of polycarbonate. In embodiments of the invention, the light-refracting block 20 is formed entirely or in part of polyethylene.

In embodiments of the invention, the light-refracting block 20 is configured for one-way sight. As an example, an individual in the interior of the dwelling can see out but an individual at the exterior of the dwelling cannot see in. This provides safety and privacy benefits. In other embodiments of the invention, the light-refracting block 20 is clear to allow an individual in the interior of the dwelling to see out and an individual at the exterior of the dwelling to see in. In further embodiments of the invention, the light-refracting block 20 is translucent (e.g. formed of a frosted material) where no individual may clearly see in from the exterior of the dwelling or out from the interior of the dwelling.

In embodiments of the invention, the light-refracting block 20 further comprises a stained-glass cover 48 over the external transmitting side 54 and/or external receiving side 52 of the block body 50 to increase aesthetic appeal while maintaining adequate light refraction into the interior of the dwelling. For example, the stained-glass cover 48 may include a name or slogan of a business associated with the building. As an alternative, the A method of installing the externally protruding window well assembly 18 to a poured concrete wall of the dwelling 10 is now described. The externally protruding window well assembly 18 is installed to a wall of the dwelling 10 by cutting away a rectangular shaped portion of the wall to create an opening 16 to insert the externally protruding window well assembly 18. In other embodiments, the opening 16 is originally manufactured into the dwelling 10, such that the externally protruding window well assembly 18 is installed during the construction of the house. In still other embodiments, another window is removed from the wall to provide the opening 18.

The externally protruding window well assembly 18, as described above, is inserted by an installer into the opening 16 of the dwelling 10. The flange 22 is positioned around the perimeter of the light-refracting block 20 to allow for coupling of the light-refracting block 20 to the poured concrete wall. The flange 22 is parallel to the siding 36 of the dwelling 10 and coupled via a plurality of fasteners 30 evenly spaced around the flange's 22 perimeter.

The outer gasket 24 is positioned vertically in line with the exterior of the poured concrete wall, securing the light-refracting block 20 around its outer perimeter. The installer fastens a reinforcing band 28 on the outside of the outer gasket 24 via a plurality of fasteners 30 or other fasteners intermittently secured to prevent the outer gasket 24 from wavering. The plurality of fasteners 30 or other fasteners is positioned evenly around the perimeter of the outer gasket 24.

The internal gasket 26 is attached by the installer to the interior of the light-refracting block 20 between the light-receiving segment 68 and the light-emitting segment 70. These components are sealed via a chemical adhesive, mechanical compression, or the like. The upper wall-interfacing side 60 of the block body 50 may be attached to a horizontal sill plate (not illustrated) via an adhesive or a plurality of screws, bolts, or other fasteners. The lower wall-interfacing side 62 of the block body 50 is attached to the poured concrete wall using a fastener 30 (which may be an adhesive).

The installer then secures the externally protruding window well assembly 18 to the wall 14. The installer drills or otherwise forms a fastener receptor 46 substantially equal in diameter to the diameter of the fastener 30 into the wall (which may include a sill plate) of the dwelling for insertion of the fastener 30. The nut 42 is threaded onto the threaded side of the fastener 30. The expansion clip 40 is then driven through a flange 22 positioned along the perimeter of the light-refracting block 20 and inserted horizontally into the fastener receptor 40 to achieve the minimum holding value for the fastener 30. Next, the anchor body 38 is driven into the surface of the poured concrete wall. Lastly, the nut 42 is tightened to position the washer 44 against a surface of the poured concrete wall until secure against the exterior of the wall, reaching a minimum torque amount (for example, at least 25-30 foot-pounds of torque). A plurality of fasteners 30 is installed in the perimeter of the flange 22 to secure the light-refracting block 20 to the poured concrete wall. In embodiments of the invention, the externally protruding window well assembly 18 may be installed into walls formed of different materials via alternative fasteners or adhesives.

Advantageously and as illustrated in FIG. 1, embodiments of the invention do not require an open, excavated area in front of the window well. Instead, and as shown in the left window well assembly 20 of FIG. 1, the ground level (and corresponding dirt) may cover at least a portion of the window well assembly 20, and in embodiments of the invention, the ground may cover at least 30, at least 50%, at least 75%, or at least 95% of the vertical height of the window well. As long as light can enter at the external receiving side 52 of the window well assembly 20, the light will be refracted through the window well and into the interior of the dwelling 10. This is an advantage over the prior art in which light travels through a window in substantially a straight line.

In an alternative embodiment of the invention, a wooden frame is secured along the perimeter of an opening 16 in a concrete block wall using concrete screws to fasten the frame to a wall of the dwelling. The externally protruding window well assembly 18, as described above, is inserted into the opening 16 in the concrete block wall of the dwelling and attached to the wooden frame. An adhesive is used around the edges of the wooden frame, such as caulk, to seal the frame to the concrete block wall. The externally protruding window well assembly 18 is attached to the interior of the wooden frame via adhesives or fasteners. The outer gasket 24 is positioned vertically in line with the exterior of the concrete block wall, securing the light-refracting block 20 around its outer perimeter. The internal gasket 26 is attached to the interior of the light-refracting block 20 around an inner perimeter for further sealing. The reinforcing band 28 is positioned on top of the outer gasket 24.

In an alternative embodiment of the invention, a method of installing the externally protruding window well assembly 18 comprising a light-refracting block 20 including a block body 50 as a polylithic unit is described. The block body 50 is comprised of a light-receiving segment 68 and a light-emitting segment 70. In embodiments of the invention the light-receiving segment 68 is secured to the light-emitting segment 70 by the installer. For example, the installer may place a clear adhesive on the light-receiving segment 68, the light-emitting segment 70, the internal gasket 26, or some combination thereof, and press them 68, 70, 26 together. The block body 50 is then installed via fasteners or adhesives and inserting the polylithic block body 50 the opening 16 in a similar method seen in installing the monolithic unit.

In an alternative embodiment of the invention, a method of installing the externally protruding window well assembly 18 to the wall of the dwelling previously comprising a window unit is described. The externally protruding window well assembly 18 is installed by removing a previous window unit and inserting the externally protruding window well assembly 18 into the opening 16 where the previous window unit was installed following the same method of installation without having to cut the opening.

Having thus described various embodiments of the invention, what is claimed as new and desired to be protected by Letters Patent includes the following:

1. A light-refracting block configured to externally protrude from a dwelling to allow natural light refraction into an interior of said dwelling comprising:

a block body, wherein said block body presents an external receiving side, an external transmitting side, an upper wall-interfacing side, a lower wall-interfacing side, and an internal emergent side, wherein said block body is configured to be installed into a wall of the dwelling, wherein the internal emergent side of the block body is substantially parallel with the wall of the dwelling, wherein the external receiving side is presented at an angle relative to the wall of the dwelling, wherein the external receiving side and the external transmitting side are disposed between the upper wall-interfacing side and the lower wall-interfacing side, wherein the external receiving side is configured to capture light, wherein the external transmitting side presents an arcuate shape so as to resist a pressure exerted by soil, such that a first end and a second end of the block body are narrower than a central segment of the block body.

2. The light-refracting block of claim 1, wherein the block body is monolithic.

3. The light-refracting block of claim 1, wherein the block body is polylithic such that the block body includes— a light-receiving segment including the external receiving side and the external transmitting side, said light-receiving segment including a first interior refraction side that is configured to be substantially vertically aligned with the exterior wall upon installation; and a light-emitting segment including the upper wall-interfacing side, the lower wall-interfacing side, and the internal emergent side, said light-emitting segment including a second interior refraction side that is configured to be secured to said first interior refraction side, wherein said light-receiving segment is configured to be attached to the light-emitting segment and installed into the exterior wall of the dwelling.

4. The light-refracting block of claim 3, wherein the block body further comprises an interior gasket disposed between the light-receiving segment and the light-emitting segment.

5. The light-refracting block of claim 1, wherein the external receiving side is slanted downward to prevent an accumulation of water thereon.

6. The light-refracting block of claim 1, wherein a vertical cross-section through a center segment of the block body is pentagonal, wherein a left transmitting side of the block body and a right transmitting side of the block body are rectangular.

7. The light-refracting block of claim 1, wherein the light-refracting block is configured to receive natural light on the external receiving side and the external transmitting side.

8. The light-refracting block of claim 1, wherein the block body is formed of a light-refracting substance.

9. The light-refracting block of claim 1, wherein the block body is formed of a semi-transparent material for one-way light transmission.

10. The light-refracting block of claim 1, wherein the block body further comprises a colored cover affixed to the external receiving side.

11. The light-refracting block of claim 1, wherein the external receiving side protrudes externally from the dwelling at least four inches.

* * * * *